US011647807B2

(12) United States Patent
Mariacher

(10) Patent No.: US 11,647,807 B2
(45) Date of Patent: May 16, 2023

(54) CLIMBING SHOE

(71) Applicant: CALZATURIFICIO S.C.A.R.P.A. S.p.A., Asolo (IT)

(72) Inventor: Heinrich Mariacher, Asolo (IT)

(73) Assignee: CALZATURIFICIO S.C.A.R.P.A. S.P.A., Asolo (IT)

( * ) Notice: Subject to any disclaimer, the term of this patent is extended or adjusted under 35 U.S.C. 154(b) by 0 days.

(21) Appl. No.: 17/077,647

(22) Filed: Oct. 22, 2020

(65) Prior Publication Data

US 2021/0120907 A1 Apr. 29, 2021

(30) Foreign Application Priority Data

Oct. 24, 2019 (IT) ..... 102019000019749

(51) Int. Cl.

| | |
|---|---|
| ***A43B 3/00*** | (2022.01) |
| ***A43B 5/00*** | (2022.01) |
| ***A43B 23/02*** | (2006.01) |
| ***A43C 11/00*** | (2006.01) |

(52) U.S. Cl.

CPC ..... *A43B 5/003* (2013.01); *A43B 3/0073* (2013.01); *A43B 23/027* (2013.01); *A43C 11/006* (2013.01)

(58) Field of Classification Search

CPC ..... A43B 3/0073; A43B 5/002; A43B 5/003; A43B 5/12; A43B 7/1495; A43B 23/027; A43C 11/006

See application file for complete search history.

(56) References Cited

U.S. PATENT DOCUMENTS

| | | | | |
|---|---|---|---|---|
| 9,801,427 | B2 * | 10/2017 | Mariacher | A43B 13/141 |
| 2004/0244226 | A1 * | 12/2004 | Farys | A43B 23/088 36/69 |
| 2020/0170332 | A1 * | 6/2020 | Mariacher | A43B 5/003 |

FOREIGN PATENT DOCUMENTS

| | | |
|---|---|---|
| EP | 1880622 A1 | 1/2008 |
| EP | 2274994 B1 | 6/2014 |
| EP | 2949233 A1 | 2/2015 |

OTHER PUBLICATIONS

Italian Search Report and Written Opinion issued by Ministero dello Sviluppo Economico for Italian Application No. IT201900019749, dated Apr. 29, 2020, pp. 1-7.

* cited by examiner

*Primary Examiner* — Sharon M Prange
(74) *Attorney, Agent, or Firm* — The Belles Group, P.C.

(57) ABSTRACT

Climbing shoe comprising: a shoe-upper shaped to accommodate and substantially cover the entire foot of the user; a polymeric-material sole fixed to the bottom of the shoe-upper so as to cover the front part of the bottom of said shoe-upper; and a sagittal tensioning band made of elastomeric material, which connects the toe of the shoe-upper directly to the rear part of the shoe-upper, in the area above the Calcaneus of the user's foot, passing underneath the sole; the sagittal tensioning band being substantially Y-shaped, so as to extend longitudinally along the tarsus-phalangeal portion of the bottom of the shoe-upper while remaining underneath the sole, and then forking into two branches that extend obliquely along the two lateral sides of the shoe-upper, up to reach the rear part of the shoe-upper.

12 Claims, 3 Drawing Sheets

CLIMBING SHOE

CROSS-REFERENCE TO RELATED APPLICATIONS

This patent application claims priority from Italian patent application no. 102019000019749 filed on Oct. 24, 2019, the entire disclosure of which is incorporated herein by reference.

TECHNICAL FIELD

The present invention relates to a climbing shoe.

BACKGROUND ART

As is known, the currently most widespread climbing shoes comprise: a shoe-upper made of leather and/or tissue which is substantially sock-shaped so as to accommodate and cover the user's foot, including the sole of the foot; a front tensioning band that is made of a high-elasticity elastomeric material, is substantially U-bent, and is fixed to the tip of the shoe-upper by gluing so as to embrace the tarsus-phalangeal portion of the user's foot; a rear tensioning band that is made of a high-elasticity elastomeric material, is substantially U-bent, and fixed by gluing astride the rear part of the shoe-upper so as to cover the area above the calcaneus of the user's foot, and then extend along the two lateral sides of the shoe-upper up to reach and join the front tensioning band; and a lower sole which is made of a soft and flexible polymeric material with a high friction coefficient and substantially inextensible, and it is fixed by gluing to the bottom of the shoe-upper locally overlaying on the front and rear tensioning bands, so as to cover the entire sole of the user's foot.

Patent EP2274994 B1 moreover discloses a climbing shoe provided with an additional tensioning band, still made of a high-elasticity elastomeric material, which is substantially V-shaped and fixed by gluing to the lower part of the shoe-upper, underneath the sole, so as to cover the bottom of the shoe-upper in the metatarsus-phalangeal area of the sole of the foot, and then extend along the two lateral sides of the shoe-upper, up to reach and join the rear tensioning band.

Unfortunately, although working very well, the above described climbing shoe has a limited adapting capability to the morphology of the user's foot, and an excessive stiffness with the operating limits that this entails.

In addition, the above described climbing shoe fails to efficiently oppose, while climbing, to the extension of the shoe-upper and the straightening of the forefoot of the user, with the limits that this entails.

The climbing shoe described above, in fact, is unsuitable for climbing rock walls that are grade IV or higher, where a high restraining capability is required.

DISCLOSURE OF THE INVENTION

Aim of the present invention is to provide a climbing shoe that is lighter than those currently in use, and is moreover capable of binding the climber's foot better adapting itself to the morphology of the user's foot, increasing at the same time the restraining capacity of the footwear.

In compliance with these aims, according to the present invention there is provided a climbing shoe as defined in Claim 1 and preferably, though not necessarily, in any one of the dependent claims.

BRIEF DESCRIPTION OF THE DRAWINGS

The present invention will now be described with reference to the accompanying drawings, which illustrate a non-limiting embodiment thereof, wherein.

BEST MODE FOR CARRYING OUT THE INVENTION

Figure 1:
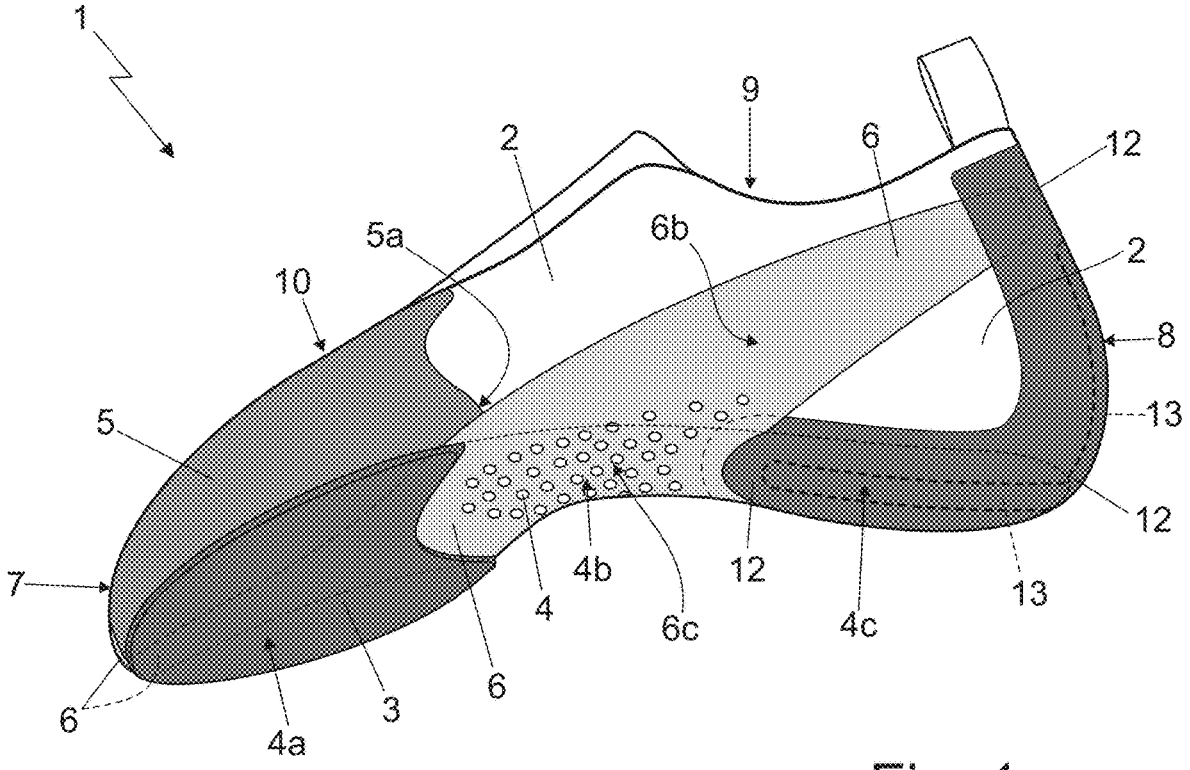
FIG. 1 is a perspective and schematic view of a climbing shoe realized according to the teachings of the present invention.

With reference to FIGS. 1, 2, 3 and 4, reference number 1 denotes as a whole a climbing shoe that may be particularly advantageously used for climbing on rock walls classified as grade IV or higher.

The climbing shoe 1 firstly comprises: a shoe-upper 2 preferably made of leather and/or fabric, which is substantially sock-shaped so as to accommodate and completely cover the user's foot, including the sole of the foot; and a front sole 3 which is made of a soft and flexible polymeric material with a high friction coefficient and preferably also inextensible, and is firmly fixed to the bottom 4 of the shoe-upper 2 preferably by gluing, so as to cover the front part of the bottom 4 of the shoe-upper 2.

In more detail, the bottom 4 of shoe-upper 2, i.e. the part/sector of shoe-upper 2 covering the sole of the user's foot, is longitudinally divided into a front or tarsus-phalangeal portion 4*a* which is immediately underneath the tarsus-phalangeal region of the sole of the user's foot; a central or plantar-arch portion 4*b* that is immediately underneath the plantar-arch region; and a rear or talus-calcaneal portion 4*c* which is immediately underneath the talus-calcaneal region of the sole of the user's foot.

The front sole 3 is preferably shaped/dimensioned so as to substantially cover the entire front or tarsus-phalangeal portion 4*a* of the bottom 4 of shoe-upper 2, and optionally also a small part of the central or plantar-arch portion 4*b*.

Preferably the front sole 3 is furthermore made of a polymeric material having a hardness (UNI 4916) preferably lower than 80 ShoreA and optionally ranging between 50 and 75 ShoreA.

In more detail, in the example shown the front sole 3 is preferably made of a soft and flexible polymeric material, such as for example the XS Edge compound or the GRIP 2 compound manufactured by the Italian company VIBRAM S.P.A.

In addition the climbing shoe 1 also comprises a plurality of tensioning bands that are made of a high-elasticity elastomeric material, are preferably pre-tensioned, and are finally firmly fixed to the shoe-upper 2 preferably by gluing, so as to embrace and tighten the shoe-upper 2 against the user's foot.

In more detail, each tensioning band has a monolithic and ribbon-like structure, and is preferably made of an elastomeric material having an elastic modulus (also known as Young's modulus) significantly lower than that of the polymeric material forming the front sole 3.

In other words, the tensioning bands are preferably made of elastomeric materials having an elastic modulus 2-10 times lower than that of the polymeric material forming the sole 3, and preferably also a hardness (UNI 4916) higher than the polymeric material forming the sole 3.

Preferably the tensioning bands are also pre-tensioned so as to tighten the shoe-upper 2 against the user's foot up to the limit of physical pain.

With reference to FIGS. 1, 2, 3 and 4, in particular, the climbing shoe 1 is provided with a front tensioning band 5 and a sagittal tensioning band 6, both with a monolithic structure and preferably pre-tensioned.

The front tensioning band 5 is substantially U-bent, and is firmly fixed to the toe 7 of the shoe-upper 2 preferably by gluing, so as to surround/embrace the front part of the bottom 4 of the shoe-upper 2, firmly joining the front sole 3 preferably by gluing.

In more detail, the front tensioning band 5 is firmly fixed to the toe 7 of the shoe-upper 2 so as to cover the area of shoe-upper 2 that surrounds/flanks the tarsus-phalangeal portion 4*a* of bottom 4, preferably also extending onto the bottom 4 of shoe-upper 2 underneath the sole 3.

In other words, the lower edge of the front tensioning band 5 extends on the bottom 4 of shoe-upper 2 so as to be at least partially overlapped by the sole 3, and is firmly fixed to the sole 3 preferably by gluing.

Preferably, the front tensioning band 5 moreover extends along the two inner and outer lateral sides of the shoe-upper 2, towards the rear part 8 of the shoe-upper 2 (i.e. towards the portion of shoe-upper 2 that covers and protects the Calcaneus of the user's foot), so that the two ends 5*a* of the band 5 reach and, optionally, also go beyond the boundary line between the tarsus-phalangeal portion 4*a* and the plantar-arch portion 4*b* of the bottom 4, preferably while remaining spaced apart one from the other.

Figure 2:
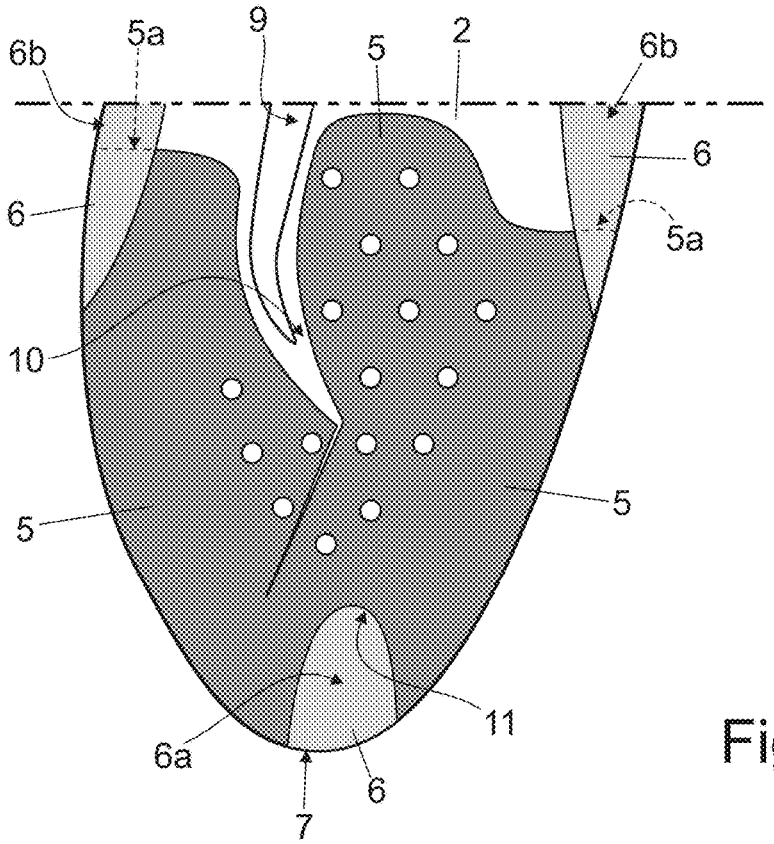
FIG. 2 is a view of the upper-front part of the climbing shoe illustrated in FIG. 1.

With particular reference to FIG. 2, in addition the central part of front tensioning band 5 is preferably also shaped so as to extend onto the upper part of shoe-upper 2 towards the instep of the user's foot, preferably substantially up to reach and, optionally, surround/embrace the front end of the upper fitting opening 9 of the shoe-upper 2, so as to cover the upper-front part 10 of shoe-upper 2 substantially without interruptions.

The front part of the user's foot is thus protected, on the bottom, by the sole 3 and, on top, by the central part of the front tensioning band 5.

Preferably the front tensioning band 5 is finally made of an elastomeric material with a hardness (UNI 4916) greater than or equal to 80 ShoreA.

With reference to FIGS. 1, 2, 3 and 4, the sagittal tensioning band 6, on the other hand, is shaped so as to connect the toe 7 directly to the rear part 8 of shoe-upper 2, in the area immediately above the Calcaneus of the user's foot, passing beneath the front sole 3.

In more detail, the sagittal tensioning band 6 is substantially Y-shaped, and extends longitudinally along the tarsus-phalangeal portion 4*a* of the bottom 4, while remaining underneath the sole 3 and preferably also remaining substantially astride the footwear midplane M, and then forks into two branches that extend obliquely along the inner and outer lateral sides of the shoe-upper 2, up to reach the rear part 8 of the shoe-upper 2, above the Calcaneus of the user's foot.

Preferably, the sagittal tensioning band 6 moreover forks substantially at the plantar-arch portion 4*b* of the bottom 4.

In other words, the sagittal tensioning band 6 extends along the tarsus-phalangeal portion 4*a* of the bottom 4 while remaining substantially astride the footwear midplane M, approximately up to reach the plantar-arch portion 4*b* of the bottom 4.

In even more detail, the sagittal tensioning band 6 preferably has an oblong and ribbon-like front segment 6*a* that extends along the tarsus-phalangeal portion 4*a* of the bottom 4, from the toe 7 towards the rear part 8 of shoe-upper 2, while remaining underneath the front sole 3 and preferably also substantially astride the centerline of the tarsus-phalangeal portion 4*a*; and two oblong and ribbon-like rear segments 6*b* that extend obliquely along the two inner and outer lateral sides of shoe-upper 2, starting from the plantar-arch portion 4*b* of bottom 4 and up to reach the rear part 8 of shoe-upper 2, immediately above the Calcaneus of the user's foot.

Moreover the sagittal tensioning band 6 preferably has, substantially at the plantar-arch portion 4*b* of bottom 4, a widened central section 6*c* from which the oblong ribbon-like segments 6*a* and 6*b* branch off.

Preferably the widened central section of the sagittal tensioning band 6 is furthermore shaped and dimensioned so as to substantially entirely cover the plantar-arch portion 4*b* of the bottom 4 of shoe-upper 2, and optionally also a small part of the tarsus-phalangeal portion 4*a*, clearly while remaining underneath the front sole 3.

Figure 4:
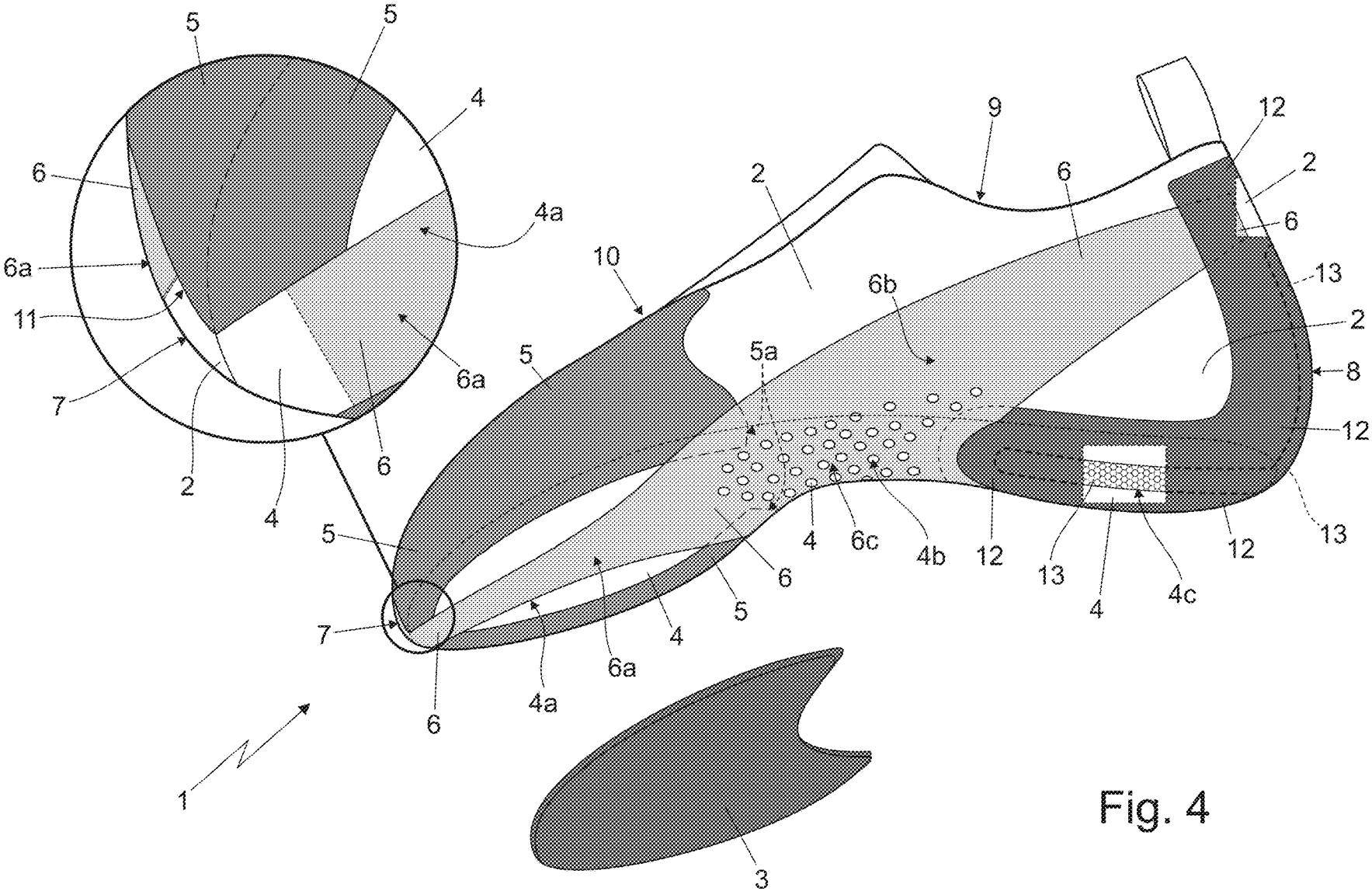
FIG. 4 is a partially exploded perspective view of the climbing shoe illustrated in FIG. 1, with parts in section and parts removed for clarity's sake.

In addition, with reference to FIGS. 2 and 4, the end part of the front ribbon-like segment 6*a* of the sagittal tensioning band 6 is preferably bent upwards like a hook, and is firmly fixed to the shoe-upper 2 so as to extend beyond the tarsus-phalangeal portion 4*a* of bottom 4 and rise up along the toe 7 of the shoe-upper 2, towards the front-upper part 10 of shoe-upper 2 (i.e. towards the instep of the user's foot), preferably covering the area of the toe 7 which is substantially astride the hallux and the second finger of the user's foot.

Preferably the front ribbon-like segment 6*a* moreover has a width that is always locally lower than the width of the tarsus-phalangeal portion 4*a* of bottom 4.

With particular reference to FIGS. 2 and 4, preferably the end part of the front ribbon-like segment 6*a* furthermore engages a corresponding oblong recess or cut-out 11 specifically made in the front tensioning band 5, so that the front ribbon-like segment 6*a* of the tensioning band 6 always remains in direct contact with the shoe-upper 2.

Preferably the shape of the oblong cut-out 11 is moreover substantially complementary to that of the end part of the front ribbon-like segment 6*a*.

Finally, in the overlapping points, the sagittal tensioning band 6 extends over and is optionally firmly fixed to the front tensioning band 5 preferably by gluing.

Similarly to the front tensioning band 5, also the sagittal tensioning band 6 is preferably made of an elastomeric material which has a hardness (UNI 4916) greater than or equal to 80 ShoreA.

Figure 3:
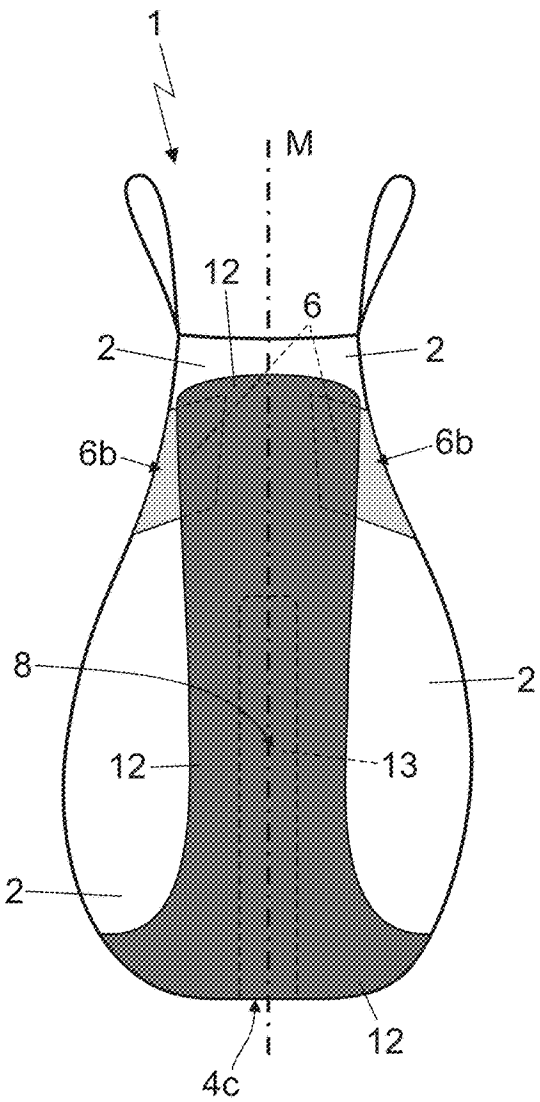
FIG. 3 is a view of the rear part of the climbing shoe illustrated in FIG. 1.

With reference to FIGS. 1, 3 and 4, preferably the climbing shoe 1 moreover also comprises a rear protective insert 12 made of soft and flexible polymeric material, which is preferably shaped as a concave shell, and is firmly fixed to the rear part 8 of shoe-upper 2 preferably by gluing, so as to cover and protect the Calcaneus of the user's foot.

The distal ends of the two rear ribbon-like segments 6*b* of sagittal band 6 are, in addition, firmly fixed to the rear protective insert 12, immediately above the Calcaneus of the user's foot, preferably by gluing.

In the example shown, in particular, the rear protective insert 12 extends over the distal end of the two rear ribbon-like segments 6*b* of the sagittal tensioning band 6.

Preferably the rear protective insert 12 is furthermore shaped/dimensioned so as to also extend on the bottom 4 of shoe-upper 2 to cover the talus-calcaneal portion 4*c* of the bottom 4, optionally prolonging also along the plantar-arch portion 4*b* underneath the sagittal tensioning band 6.

In other words, the rear protective insert 12 is preferably oblong in shape and is substantially L-bent so to simultaneously cover the talus-calcaneal portion 4*c* of the bottom 4 and the rear part 8 of shoe-upper 2, while remaining substantially astride the footwear midplane M.

Preferably the polymeric material forming the rear protective insert 12 moreover has a hardness (UNI 4916) that is higher than the polymeric material forming the sole 3 and/or the elastomeric material forming the sagittal tensioning band 6.

In the example shown, in particular, the rear protective insert 12 is preferably made of a polymeric material having a hardness (UNI 4916) preferably lower than 75 ShoreA and optionally ranging between 50 and 65 ShoreA.

In addition the rear protective insert 12 is made of a polymeric material that has an elastic modulus preferably greater than that of the elastomeric material forming which the tensioning bands 5 and/or 6, and also optionally greater than that of the polymeric material forming the sole 3.

With reference to FIGS. 1, 3 and 4, the climbing shoe 1 is preferably finally provided with a semi-rigid counter 13 preferably made of semi-rigid polymeric material, which is firmly fixed to the shoe-upper 2 immediately underneath the rear protective insert 12.

In more detail, the semi-rigid counter 13 has a ribbon-like structure, is substantially L-bent, and is firmly fixed to the rear part of bottom 4, or rather on the talus-calcaneal portion 4*c* of bottom 4, and to the rear part 8 of shoe-upper 2, substantially astride the midplane M, so as to locally stiffen the climbing shoe 1.

Preferably the semi-rigid counter 13 is moreover made of nylon or of thermoplastic polyurethane (TPU), and is preferably firmly fixed to the shoe-upper 2 and to the rear protective insert 12 by gluing.

Operation of climbing shoe 1 is easily inferable from the above description.

The advantages associated to the specific shape and arrangement of the sagittal tensioning band 6 are remarkable.

Firstly, experimental tests highlighted that the Y-shaped sagittal tensioning band 6, extending without interruptions from the toe 7 to the rear part 8 of shoe-upper 2, immediately above the user's Calcaneus, forces the tip of the user's foot to bend downward more pronouncedly, improving the retaining capability of the footwear.

In addition the sagittal tensioning band 6, acting directly on the toe 7 of the shoe-upper 2, allows to keep the user's foot in an arched posture more matching with the morphology of the foot, thus greatly improving the wear comfort.

Furthermore, the Y-shape of the sagittal tensioning band 6 allows to pre-tighten the inner side and the outer side of the footwear in a differentiated way, allowing the climbing shoe 1 to adapt more to the morphology of the user's foot.

Finally the climbing shoe 1 is sensibly lighter than the climbing shoes currently on the market, with all the advantages that this entails.

It is finally clear that modifications and variations may be made to the climbing shoe 1 without however departing from the scope of the present invention.

For example, the front ribbon-like segment 6*a* of sagittal tensioning band 6 could overlap and be firmly to the front tensioning band 5 which, in this case, would lack the cut-out 11.

Figure 5:
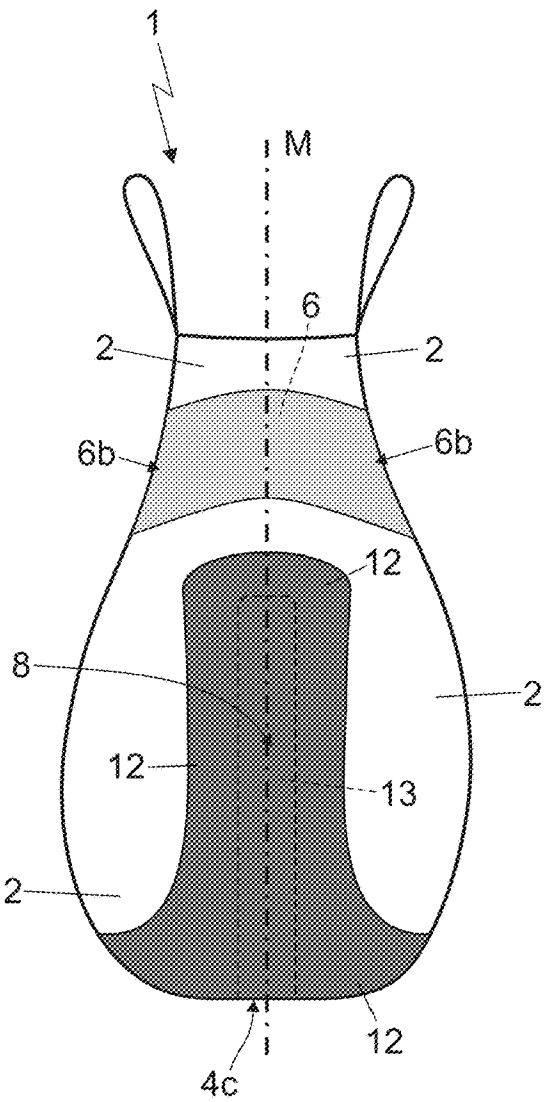
FIG. 5 is a view of the rear part of a first construction variant of the climbing shoe illustrated in FIG. 1.

With reference to FIG. 5, in a second embodiment, moreover, the distal ends of the two rear ribbon-like segments 6*b* of sagittal tensioning band 6 firmly connect/join to one another immediately above the Calcaneus of the user's foot and preferably without interruptions, so as to form a closed loop made of an elastomeric material.

In this case the rear protective insert 12 is preferably shaped and placed so as not to extend over/overlap the sagittal tensioning band 6 at the rear part 8 of shoe-upper 2.

Figure 6:
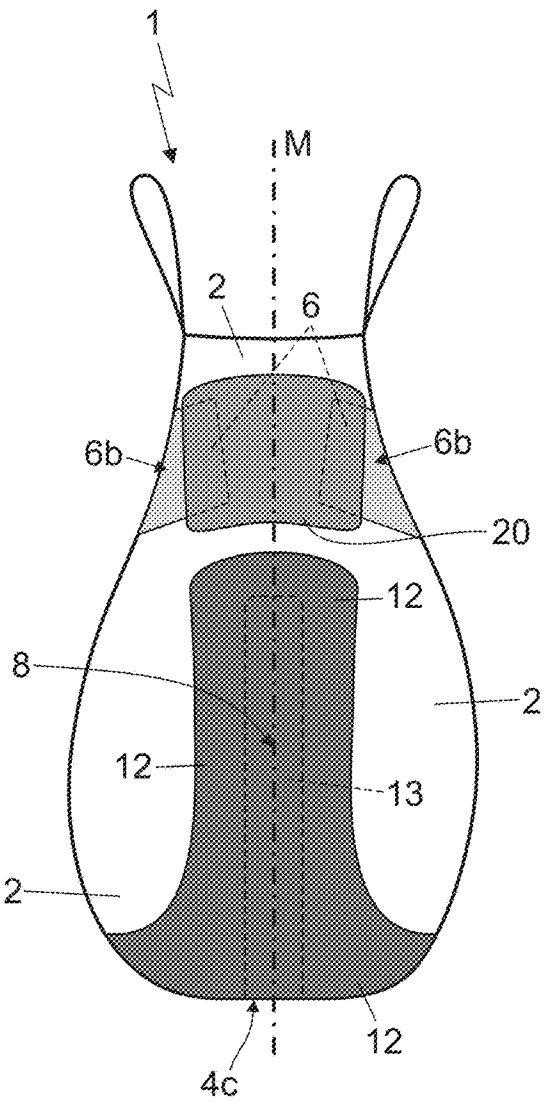
FIG. 6 is a view of the rear part of a second construction variant of the climbing shoe shown in FIG. 1.

Finally, with reference to FIG. 6, in a different embodiment, the climbing shoe 1 is provided with a small patch 20 made of soft and flexible material, which is firmly placed/fixed to the rear part 8 of shoe-upper 2, in the area immediately above the user's Calcaneus and substantially astride the footwear midplane M, preferably by gluing; and the rear protective insert 12, if present, is preferably shaped and arranged so as to remain spaced underneath the patch 20.

In this embodiment, the two rear ribbon-like segments 6*b* of the sagittal tensioning band 6 extend along the two inner and outer lateral sides of shoe-upper 2, up to reach and firmly connect to the rear patch 20.

In more detail, the distal ends of the two rear ribbon-like segments 6*b* preferably extend underneath the rear patch 20, and are firmly fixed to the patch 20 preferably by gluing.

In other words, the rear patch 20 extends over the distal ends of the two rear ribbon-like segments 6*b* of the sagittal tensioning band 6.

In the example shown, in particular, the patch 20 is preferably made of a soft and flexible polymeric material and optionally also substantially inextensible, and is preferably firmly fixed to the rear part of the shoe-upper 2 preferably by gluing.

Preferably the polymeric material forming the rear patch 20 additionally has a hardness lower than the elastomeric material forming the sagittal tensioning band 6.

The invention claimed is:

1. A climbing shoe comprising: a shoe-upper shaped to accommodate and cover substantially an area of a whole user's foot; a polymeric-material sole fixed to a bottom of the shoe-upper so as to cover a front part of the bottom of the shoe-upper; and a sagittal tensioning band made of elastomeric material, which connects a toe of the shoe-upper directly to a rear part of the shoe-upper, and is configured to be located in an area of the shoe-upper located above a Calcaneus of the user's foot, passing underneath the sole;

wherein the sagittal tensioning band has a monolithic structure and is substantially Y-shaped so as to have a ribbon-like front segment that extends along a tarsus-phalangeal portion of the bottom of the shoe-upper, from the toe of the shoe-upper towards the rear part of the shoe-upper, while remaining underneath the sole, and two ribbon-like rear portions that extend obliquely along the two lateral sides of the shoe-upper, starting from a plantar-arch portion of the bottom of the shoe-upper and up to reach the rear part of the shoe-upper, and wherein the ribbon-like front segment of the sagittal tensioning band is bent upwards like a hook, and is fixed to the shoe-upper so as to protrude from the tarsus-phalangeal portion of the bottom and then rise along the toe of the shoe-upper, towards an upper wear opening of the shoe-upper.

2. The climbing shoe according to claim 1, wherein the sagittal tensioning band forks substantially at the plantar-arch portion of the bottom of the shoe-upper.

3. The climbing shoe according to claim 1, wherein the ribbon-like front segment of the sagittal tensioning band extends along the tarsus-phalangeal portion of the bottom of the shoe-upper while remaining substantially astride the centerline of the tarsus-phalangeal portion of the bottom of the shoe-upper.

4. The climbing shoe according to claim 1, wherein the sagittal tensioning band has, at the plantar-arch portion of the bottom, a widened central section from which the ribbon-like front segment and the two ribbon-like rear segments branch off.

5. The climbing shoe according to claim 4, wherein the widened central section of the sagittal tensioning band is shaped and dimensioned so as to cover substantially the whole plantar-arch portion of the bottom of the shoe upper.

6. The climbing shoe according to claim 1, wherein the shoe additionally comprises a front tensioning band made of elastomeric material, which is substantially U-bent and is firmly fixed to the toe of the shoe-upper so as to surround the front part of the bottom of the shoe-upper, firmly joining the sole.

7. The climbing shoe according to claim 6, wherein the ribbon-like front segment of the sagittal tensioning band engages a corresponding recess or cut-out made in the front tensioning band, so as to remain in direct contact with the shoe-upper.

8. The climbing shoe according to claim 7, wherein said recess or cut-out is substantially complementary in shape to that of the end part of the ribbon-like front segment of sagittal tensioning band.

9. The climbing shoe according to claim 1, further comprising a rear protective insert made of polymeric material, which is shaped substantially like a concave shell, and is firmly fixed to the rear part of the shoe-upper, so as to cover and protect an area immediately proximate to the Calcaneus of the user's foot.

10. The climbing shoe according to claim 9, wherein the distal ends of the two ribbon-like rear portions of the sagittal tensioning band are firmly fixed to the rear protective insert, and are configured to be in an area immediately above the Calcaneus of the user's foot.

11. The climbing shoe according to claim 1, wherein the distal ends of the two ribbon-like rear segments of the sagittal tensioning band join one to the other in an area configured to be above the user's calcaneus, so as to form a closed loop made of elastomeric material.

12. The climbing shoe according to claim 1, further comprising a small patch made of soft and flexible material, which is placed on the rear part of the shoe-upper, in the area configured to be above the user's Calcaneus; the two ribbon-like rear segments of the sagittal tensioning band extend along the two lateral sides of the shoe-upper, up to reach and firmly connect to said patch.

* * * * *